US009219324B2

(12) United States Patent
Wittmann

(10) Patent No.: US 9,219,324 B2
(45) Date of Patent: Dec. 22, 2015

(54) PLUG CONNECTOR HAVING A FIRST-MATE GROUNDING CONTACT

(71) Applicant: Rolf Wittmann, Ludwigsburg (DE)

(72) Inventor: Rolf Wittmann, Ludwigsburg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 136 days.

(21) Appl. No.: 14/022,892

(22) Filed: Sep. 10, 2013

(65) Prior Publication Data

US 2014/0073192 A1 Mar. 13, 2014

(30) Foreign Application Priority Data

Sep. 13, 2012 (DE) ..... 10 2012 216 249

(51) Int. Cl.

| | |
|---|---|
| ***H01R 13/502*** | (2006.01) |
| ***H01R 13/46*** | (2006.01) |
| ***H01R 13/516*** | (2006.01) |
| ***H01R 13/648*** | (2006.01) |

(52) U.S. Cl.

CPC ..... *H01R 13/46* (2013.01); *H01R 13/516* (2013.01); *H01R 13/6485* (2013.01)

(58) Field of Classification Search

CPC ..... H01R 13/4223; H01R 13/6215
USPC ..... 439/701, 685, 686, 855, 854, 540.1
See application file for complete search history.

(56) References Cited

U.S. PATENT DOCUMENTS

| | | | | |
|---|---|---|---|---|
| 4,924,345 | A * | 5/1990 | Siemon et al. | 361/111 |
| 5,509,823 | A * | 4/1996 | Harting et al. | 439/607.17 |
| 7,658,653 | B2 * | 2/2010 | Diekmann et al. | 439/715 |

FOREIGN PATENT DOCUMENTS

DE 10 2010 063 486 6/2012

* cited by examiner

*Primary Examiner* — Phuongchi T Nguyen
(74) *Attorney, Agent, or Firm* — Kenyon & Kenyon LLP

(57) ABSTRACT

A connector is described for establishing an electrical connection to a plug. The connector has a housing having an inner surface and a plurality of contact chambers. Each contact chamber is designed to establish an electrical connection with respectively one plug contact of the plug. A contact chamber has an outer surface and is designed to be movable in one direction parallel to an insertion direction of the plug in order to assume an inserted state or an extended state.

10 Claims, 3 Drawing Sheets

PLUG CONNECTOR HAVING A FIRST-MATE GROUNDING CONTACT

CROSS REFERENCE TO RELATED APPLICATION

The present application claims priority to Application No. DE 10 2012 216 249.6, filed in the Federal Republic of Germany on Sep. 13, 2012, which is expressly incorporated herein in its entirety by reference thereto.

FIELD OF INVENTION

The present invention relates to electrical connectors. The present invention concerns in particular a connector for establishing an electrical connection to a plug as well as a connecting element for establishing an electrical connection.

BACKGROUND INFORMATION

Connectors and plugs are used to establish a releasable electrical connection. For this purpose, the connector may have a plurality of contact chambers, each contact chamber being designed to establish an electrical connection to one plug contact of a plug. When the plug is connected to the connector, multiple plug contacts of the plug are inserted into respectively associated contact chambers of the connector and establish together with the latter a mechanical and electrically conductive connection.

German Application No. DE 10 2010 063 486 describes such an exemplary electrical connector as well as its fundamental functionality.

SUMMARY

The present invention allows for a secure establishment of an electrical connection between a plug and a connector and reduces the danger of damage through electrical charges in electronics connected to the plug or to the connector.

A connector for establishing an electrical connection to a plug as well as a connecting element for establishing an electrical connection is described.

According to a first exemplary embodiment of the present invention, a connector is described for establishing an electrical connection with a plug, the connector having a housing that has an inner surface and a plurality of contact chambers. Each contact chamber is designed to establish an electrical connection with respectively one plug contact of the plug. The connector is characterized by the fact that at least one contact chamber has an outer surface and is designed to be movable in one direction parallel to an insertion direction of the plug in order to assume an inserted state or an extended state.

The at least one movable contact chamber is designed to perform or carry out a motion relative to the housing of the connector and relative to at least one other contact chamber of the connector.

In the extended state of the movable contact chamber, this contact chamber represents a so-called first-mate contact since the contact chamber in the extended state is contacted first by a plug, which is guided in the direction of the connector and plugged, and thus is the first contact chamber to establish an electrical connection to one of the plug contacts of the plug. This makes it possible for example to determine the sequence in which an electrical contact is established between a plug contact of the plug and an associated or assigned contact chamber of the connector.

A connector as described above and in the following may have one or multiple movable contact chambers. Each of the movable contact chambers may be moved over the same length or over lengths that differ from one another. Aside from the movable contact chamber(s), the connector may have one or multiple non-movable contact chambers.

According to one exemplary embodiment of the present invention, the connector is developed to oppose a first mechanical resistance to the motion of the movable contact chamber in the insertion direction and to oppose a second mechanical resistance to a motion of the movable contact chamber in the extension direction, the first mechanical resistance being greater than the second mechanical resistance. In other words, there should exist an asymmetrical mechanical resistance relation between inserting the plug contact into the contact chamber and pulling the plug contact out of the contact chamber.

In a plugging motion of the plug onto such a connector, this makes it possible that first a plug contact of the plug is inserted into the contact chamber that is in the extended state and the contact chamber is moved into the inserted state only subsequently by the further motion of the plug in the insertion direction and in the process the other plug contacts of the plug electrically contact respectively one of the other contact chambers of the connector that is not in the extended state.

Since in a motion of the movable contact chamber in the insertion direction the first mechanical resistance is greater than the second mechanical resistance in the extension direction, this means that in a motion of the plug in the extension direction first the movable contact chamber is moved together with the plug contact and the plug in the extension direction and the plug contact of the plug located in the movable contact chamber is pulled out only when the movable contact chamber has reached the extended state. Before the movable contact chamber has reached the extended state, the other plug contacts of the plug may already have left their associated contact chambers of the connector such that there no longer exists an electrical contact between the other plug contacts and the other contact chambers.

According to another exemplary embodiment of the present invention, the inner surface of the housing is contoured and extends along the insertion direction of the movable contact chamber. The contoured inner surface is developed so as to bring about the first mechanical resistance and the second mechanical resistance when the movable contact chamber is moved.

The contoured inner surface may for example have a roughened or granulated surface so as to increase a mechanical friction resistance of the contact chamber, which moves abutting on the inner surface along the inner surface. The inner surface may have depressions and elevations, for example in a saw tooth pattern. The saw tooth pattern may be developed in particular to be asymmetrical in a cross section such that the rise of the individual teeth in the extension direction differs from the rise in the individual teeth in the insertion direction.

According to another exemplary embodiment of the present invention, the outer surface of the movable contact chamber is contoured and disposed to move along the inner surface of the housing when the movable contact chamber is moved.

The outer surface of the movable contact chamber may thus contact the inner surface of the housing and because both the outer surface of the movable contact chamber as well as the inner surface of the housing are contoured, it is possible to produce a mechanical friction resistance of the contact chamber with respect to the housing. The above explanations regarding the inner surface of the housing apply analogously to the outer surface of the contact chamber.

According to another exemplary embodiment of the present invention, at least one section of the outer surface of the movable contact chamber or of the inner surface of the housing has a friction-increasing coating.

The friction-increasing coating may be a rubberized section for example, or there may be a rubber ring disposed between the contact chamber and the housing for example. The rubber ring may be disposed in particular so as to run around the contact chamber. Irrespective of the use of the term rubber ring, the possible cross-sectional geometry of the contact chamber is not limited thereby since a rubber ring is able to adapt to any cross-sectional geometry, for example quadrangular or round.

The section that has a friction-increasing coating may be for example a subsection of the inner surface of the housing in the insertion direction or extension direction.

According to another exemplary embodiment of the present invention, the movable contact chamber has a jamming element, which is disposed to protrude from the outer surface of the movable contact element in the direction of the inner surface of the housing so as to produce the asymmetrical mechanical resistance relation.

The jamming element may be situated on the outer surface of the contact element and enclose a specific angle between the outer surface and the longitudinal extent of the jamming element. Starting from an attachment point of the jamming element on the outer surface, the jamming element protrudes in the insertion direction, as a result of which a jamming element disposed in this manner produces the asymmetrical mechanical resistance relation.

According to another exemplary embodiment of the present invention, the contact chamber has a contact element having a contact wall, the contact wall, in the event of a motion of the contact wall in a direction toward the outer surface of the contact chamber, exerting a force effect on the jamming element such that the jamming element moves in a direction toward the outer surface and away from the inner surface of the housing.

The jamming element may be developed for example in the form of a lever or a rocker, the contact wall of the contact element pressing on one side of the lever such that the other side of the lever, i.e., of the contact element, moves away from the inner surface of the housing, thus reducing a mechanical resistance in a motion of the contact chamber with respect to the housing.

This construction also makes it possible for the movable contact chamber to latch in the extended state and to allow it to be moved from this latched stage of the extended state in the direction of the inserted state only when the contact wall moves the jamming element and thus cancels the latched status. The contact wall, for example, may be pressed by a plug contact inserted into the contact chamber in the direction of the jamming element such that the jamming element loses the mechanical contact with the inner surface of the housing as a result of this motion of the contact wall. This makes it possible to ensure that the contact chamber is moved from the extended state into the inserted state only when a plug contact of the plug is located in the contact chamber or contact element. As long as the plug contact is in the contact chamber, the contact chamber is able to move with a reduced mechanical resistance such that the movable contact chamber initially moves along with the plug and the plug contact when the plug is moved in the extension direction until the movable contact chamber has reached the extended state. In the extended state, the plug contact located in the movable contact chamber is then also pulled out of this contact chamber, the contact wall of the contact element in the contact chamber no longer exerting a force effect on the jamming element and the jamming element thus moving in the direction of the inner surface of the housing and the movable contact element latching in the extended state.

According to another exemplary embodiment of the present invention, exactly one contact chamber is designed to be movable in order to assume an inserted state or an extended state with respect to the housing of the connector.

This precisely one contact chamber may be for example a ground terminal, the plug connector, as described above and in the following, making it possible that the ground terminal is the first to establish electrical contact in a plugging motion of the plug and that it is the last to be disconnected when the plug is pulled from the connector.

In particular, this may avoid damage as may arise by electrical charges in an electronic system. As described above and in the following, the connector allows in particular for a space-saving design since a first-mate grounding contact does not require any extended plug contacts for which additional space would have to be provided in a plugged state of the plug.

According to another exemplary embodiment of the present invention, a connecting element is indicated for establishing an electrical connection, the connecting element having a connector as described above and in the following as well as a plug having a plurality of plug contacts. At least one plug contact is designed to establish an electrical connection with a movable contact chamber that is in the extended state and to move the movable contact chamber in the insertion direction such that the plug establishes an electrical connection with the connector.

It should be pointed out in particular that the plug contact, which is disposed so as to establish an electrical connection with the movable contact chamber, establishes this electrical connection before any other plug contact of the plug establishes an electrical connection with any other contact chamber of the connector.

According to one exemplary embodiment of the present invention, the plug contact electrically connected to the movable contact chamber moves the movable contact chamber in the extension direction when the plug is moved in the extension direction. For this purpose, the plug contact electrically connected with the movable contact chamber is designed to be pulled out of the movable contact chamber in the extension direction only when the movable contact chamber is in the extended state.

This means furthermore that those plug contacts of the plug that are electrically connected with non-movable contact chambers first leave these contact chambers such that their electrical connection is broken before the plug contact that is electrically connected with the movable contact chamber is disconnected from the movable contact chamber.

Exemplary embodiments of the present invention are described in the following with reference to the accompanying figures.

Figure 1:
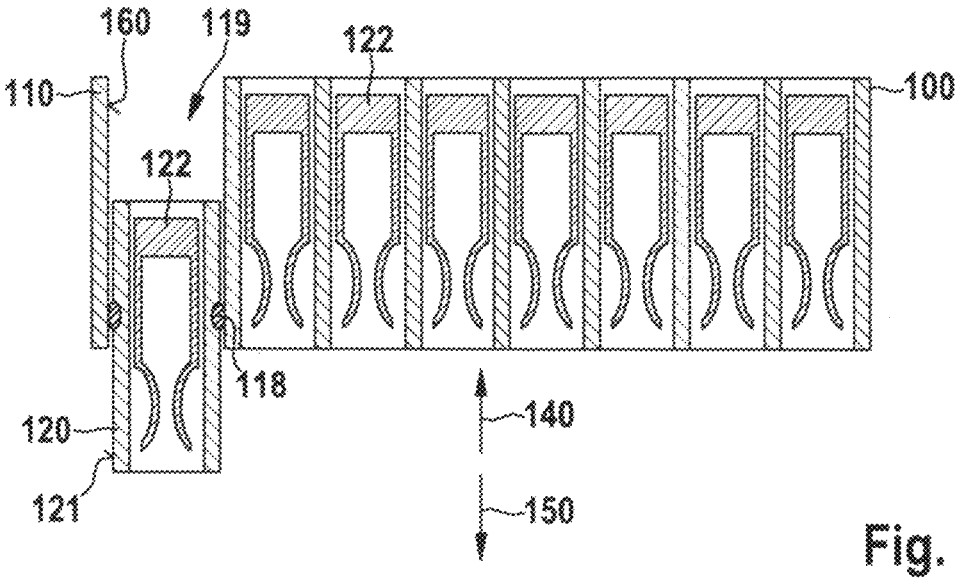
FIG. 1 shows a schematic representation of a connector according to one exemplary embodiment of the present invention.

The representations in the figures are schematic and not true to scale.

If identical reference numerals are used in the following description of figures, then these refer to identical or similar elements.

DETAILED DESCRIPTION

FIG. 1 shows a connector 100 having eight contact chambers 120, each of which has one contact element 122. Connector 100 has a housing 110, which encloses contact chambers 120. One of contact chambers 120 is designed as a movable contact chamber 119, while the other contact chambers 120 are fixed in place in housing 110. Between an outer surface 121 of movable contact chamber 119 and housing 110 on one side and an adjacent contact chamber on the other side there is a mechanical resistance element in the form of a rubber ring 118 surrounding the movable contact chamber 119.

The movable contact chamber, of course, may be situated at any position in the connector. This may thus be a contact chamber located at the edge of the adjacently arranged contact chambers, or it may equally be a contact chamber that is situated between two non-movable contact chambers and is designed to be movable. The explanations that concern the interaction between the outer surface of the movable contact chamber and the inner surface of the housing also apply analogously to the contact chambers or their outer surface in relation to the outer surfaces of a contact chamber situated between them.

FIG. 1 shows the movable contact chamber 119 in the extended state. In order to reach the inserted state, the movable contact chamber would have to be moved in the insertion direction 140. In the inserted state, the movable contact chamber may be situated at the same level as the other contact chambers, which means that all contact chambers 120 of connector 100 are flush with respect to one another in the insertion direction.

Figure 2:
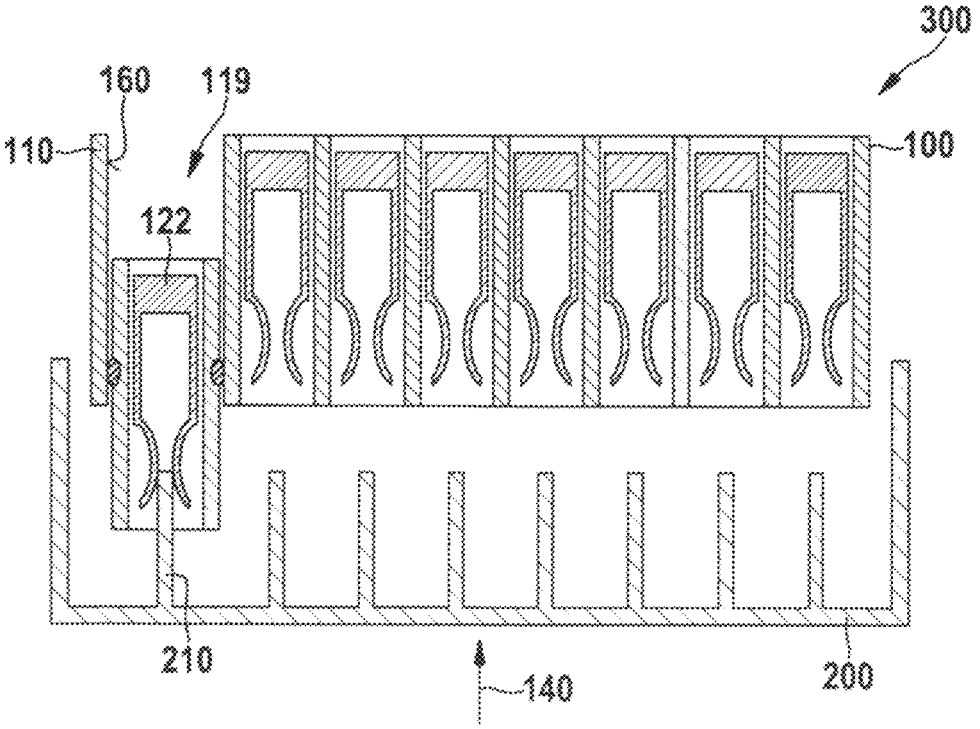
FIG. 2 shows a schematic representation of a connective element according to another exemplary embodiment of the present invention.

FIG. 2 shows a connecting element 300 having a connector 100 and a plug 200. Plug 200 has a plurality of plug contacts 210, each plug contact 210 being assignable to one contact chamber or one contact element 122 of a contact chamber, i.e., each plug contact 210 is able to establish an electrical connection with respectively one contact element 122.

Analogously to FIG. 1, FIG. 2 shows movable contact chamber 119 also in the extended state. One plug contact 210 of plug 200 has already established an electrical connection to contact element 122 of the extended movable contact chamber, while the movable contact chamber is still in the extended state. The other plug contacts have not yet established an electrical connection to their associated contact chambers. If plug 200 is now moved further in insertion direction 140, this causes plug 200 to strike against the extended movable contact chamber and move the movable contact chamber from the extended state into the inserted state such that the other plug contacts 210 of plug 200 establish respectively an electrical connection with their associated contact chambers of the connector.

So that plug contact 210 may be inserted into contact chamber 120 without the movable contact chamber being moved from the extended state to the inserted state, both plug contact 210 and the movable contact chamber must have a lower friction or lower mechanical resistance with respect to each other than is the case between the movable contact chamber and housing 110 such that first plug contact 210 is inserted into contact element 122 before the movable contact chamber is moved into the inserted state.

Figure 3:
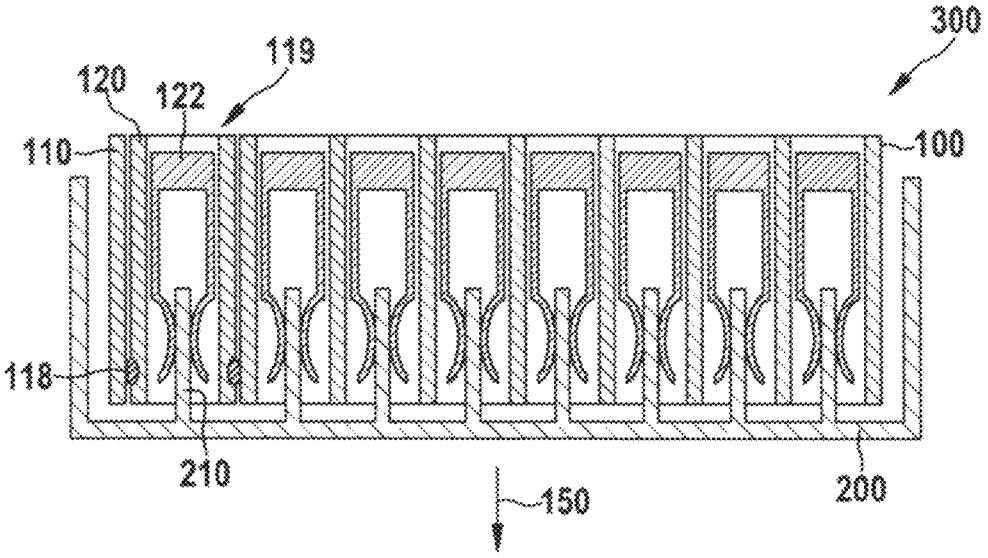
FIG. 3 shows a schematic representation of a connective element according to another exemplary embodiment of the present invention.

FIG. 3 shows a connecting element 300, plug 200 having been plugged completely onto connector 100. Movable contact chamber 119 is now in the inserted state and all plug contacts 210 of plug 200 have established an electrical connection to their associated contact chambers 119, 120.

If plug 200 is now moved in the extension direction 150, then movable contact chamber 119 is moved first together with plug contact 210 inserted into the movable contact chamber in the extension direction 150, the electrical connection between the other plug contacts and their respectively associated contact chambers being broken at the same time. Only after the electrical connection has been broken between the plug contacts and the non-movable contact chambers will the movable contact chamber reach the extended state, the electrical connection between the movable contact chamber and the plug contact inserted into it being broken only now.

When plug 200 is moved in the extension direction 150, a friction resistance or a mechanical resistance between plug contact 210 and contact element 122 of movable contact chamber 119 must be greater than between the movable contact chamber and housing 110 as well as the contact chamber adjacent to the movable contact chamber such that the movable contact chamber is moved relative to the housing of the connector such that the plug contact that is electrically connected to the movable contact chamber is removed from the contact element 122 of movable contact chamber 119 only after the movable contact chamber has been moved from the inserted state into the extended state.

Figure 4A:
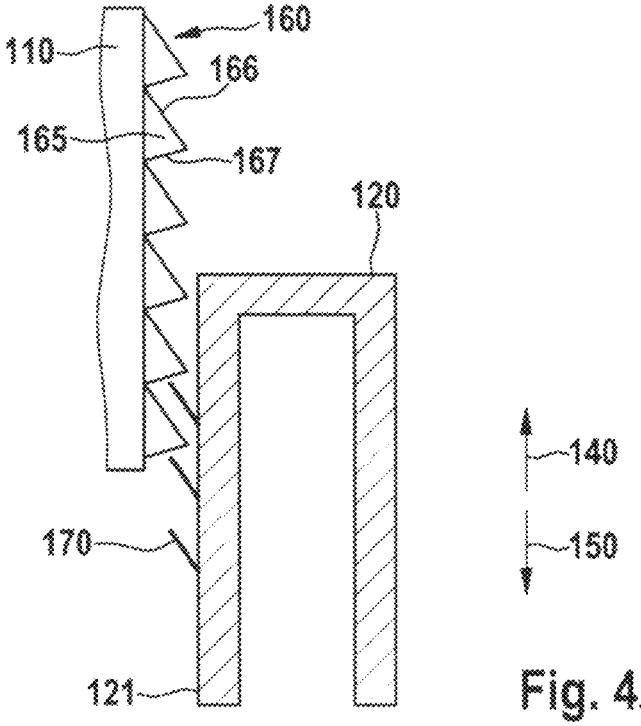
FIG. 4A shows a schematic representation of a contact element and a housing of a connector according to another exemplary embodiment of the present invention.

FIG. 4A shows a contact chamber 120 and a part of a housing 110. Contact chamber 120 has jamming elements 170, which are situated on an outer surface 121 of the contact chamber and which extend protruding from outer surface 121 in insertion direction 140. Inner surface 160 of housing 110 has a surface that is sawtooth-shaped in its cross section, the second contour surface 167 pointing in the extension direction 150 being steeper than the first contour surface 166 pointing in the insertion direction 140.

The different angles of inclination of first contour surface 166 and second contour surface 167 as well as of the jamming elements 170 protruding in the insertion direction cause the asymmetrical mechanical resistance relation when moving contact chamber 120.

The sawtooth contour 166, 167 and jamming elements 170 may also be switched, i.e., so that jamming elements 170 are situated on the inner surface of the housing and the sawtooth contour is situated on the outer surface of the contact chamber. In order to achieve the asymmetrical mechanical resistance relation, the projection direction of the jamming elements and the inclines of the sawtooth contour would have to be changed in this case, i.e., so that jamming elements 170 and the gently inclined slopes 166 project in the extension direction 150 and the steep slope 167 projects in the insertion direction. Alternatively or additionally, plug contact 210 and contact element 122 may have at their points of contact respectively a contoured surface analogous to the connections between the outer surface of the contact chamber and the inner surface of the housing.

Figure 4B:
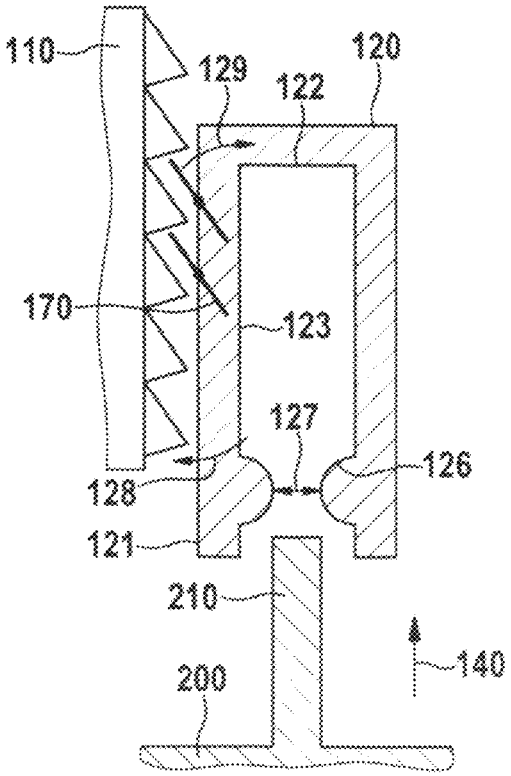
FIG. 4B shows a schematic representation of a contact chamber and a housing of a connector according to another exemplary embodiment of the present invention.

As a complement to FIG. 4A, FIG. 4B shows lever-like jamming elements 170 on outer surface 121 of contact chamber 120.

If a plug contact 210 of plug 200 is pushed into contact element 122 of contact chamber 120 in insertion direction 140, then a contact wall 123 of contact element 122 moves in the direction of outer surface 121 of the contact chamber, as indicated by arrow 128. The movement of contact wall 123 in direction 128 is caused by the fact that contact element 122 has an indentation 126 such that an inner diameter 127 of contact element 122 is smaller than the width of contact element 210, whereby contact wall 123 is moved outward when inserting plug contact 210. A force effect is thereby exerted on jamming element 170 such that jamming element 170 performs a tilting or rotary motion in the direction of arrow 129 such that the contact chamber may be moved from a latched status in the extended state into the insertion direction since jamming elements 170 are no longer locked with the inner surface of the housing.

What is claimed is:

1. A connector for establishing an electrical connection to a plug, the connector comprising:

a housing including an inner surface and a plurality of contact chambers, each contact chamber being adapted to establish an electrical connection with respectively one plug contact of the plug, wherein at least one contact chamber includes an outer surface and is adapted to be movable in a direction parallel to an insertion direction of the plug in order to assume an inserted state or an extended state, wherein the at least one moveable contact chamber and its respective plug contact both have a lower friction or lower mechanical resistance with respect to each other as compared with a friction or a mechanical resistance between the at least one movable contact chamber and the housing such that the respective plug contact is configured to be inserted into the at least one moveable contact chamber before the at least one movable contact chamber is moved into the inserted state.

2. The connector according to claim 1, wherein the connector is adapted to oppose a first mechanical resistance to a motion of the movable contact chamber in the insertion direction and to oppose a second mechanical resistance to a motion of the movable contact chamber in an extension direction, the first mechanical resistance being greater than the second mechanical resistance.

3. The connector according to claim 1, wherein the inner surface of the housing is contoured, the contoured inner surface extending along the insertion direction of the movable contact chamber, the contoured inner surface being adapted to bring about the first mechanical resistance and the second mechanical resistance in a motion of the movable contact chamber.

4. The connector according to claim 1, wherein the outer surface of the movable contact chamber is contoured, the contoured outer surface being adapted to move along the inner surface of the housing when the movable contact chamber is moved.

5. The connector according to claim 1, wherein at least one section of the outer surface of the movable contact chamber or of the inner surface of the housing includes a friction-increasing coating.

6. The connector according to claim 1, wherein exactly one contact chamber is adapted to be movable to assume the inserted state or the extended state.

7. The connector according to claim 1, wherein the movable contact chamber includes a jamming element, which is adapted to protrude from the outer surface of the movable contact element in a direction of the inner surface of the housing such that a mechanical resistance is greater in a motion of the movable contact chamber in an insertion direction than the mechanical resistance in a motion of the movable contact chamber in an extension direction.

8. The connector according to claim 7, wherein the movable contact chamber includes a contact element having a contact wall, the contact wall exerting a force effect on the jamming element in a direction toward the outer surface such that the jamming element moves in the direction toward the outer surface and away from the inner surface of the housing.

9. A connecting element for establishing an electrical connection, comprising:

the connector according to claim 1; and a plug including a plurality of plug contacts, at least one plug contact being adapted to establish an electrical connection with the movable contact chamber when the movable contact chamber is in the extended state and to move the movable contact chamber in the insertion direction such that the plug establishes an electrical connection with the connector.

10. The connecting element according to claim 9, wherein the plug contact is electrically connected to the movable contact chamber moving the movable contact chamber in an extension direction when the plug is moved in the extension direction, the plug contact electrically connected to the movable contact chamber being adapted to be pulled out of the movable contact chamber in the extension direction only when the movable contact chamber is in the extended state.

* * * * *